US008881670B2

(12) United States Patent
Binkley

(10) Patent No.: US 8,881,670 B2
(45) Date of Patent: Nov. 11, 2014

(54) RECLOSER POSITION INDICATOR

(75) Inventor: Kerry Brent Binkley, Lake Mary, FL (US)

(73) Assignee: ABB Technology AG, Zürich (CH)

( * ) Notice: Subject to any disclaimer, the term of this patent is extended or adjusted under 35 U.S.C. 154(b) by 314 days.

(21) Appl. No.: 13/578,675

(22) PCT Filed: Feb. 9, 2011

(86) PCT No.: PCT/US2011/024122

§ 371 (c)(1), (2), (4) Date: Aug. 31, 2012

(87) PCT Pub. No.: WO2011/102997

PCT Pub. Date: Aug. 25, 2011

(65) Prior Publication Data

US 2013/0008369 A1 Jan. 10, 2013

Related U.S. Application Data

(60) Provisional application No. 61/304,826, filed on Feb. 16, 2010.

(51) Int. Cl.

| | |
|---|---|
| ***H01H 9/16*** | (2006.01) |
| ***H01H 71/04*** | (2006.01) |
| ***G09F 11/18*** | (2006.01) |

(52) U.S. Cl.

CPC . *H01H 9/16* (2013.01); *G09F 11/18* (2013.01)
USPC ..... 116/281; 116/283; 116/278; 335/17

(58) Field of Classification Search

CPC ..... G09F 11/18; G09F 11/20; G09F 11/21; G09F 11/22; H01H 9/16; H01H 9/161; H01H 33/38; H01H 33/666; H01H 71/04; H01H 2009/0292
USPC ..... 116/277, 278, 281, 283, 284, 285, 286, 116/298, 299, 305; 200/308; 355/17, 26, 355/27, 28; 361/114, 115
See application file for complete search history.

(56) References Cited

U.S. PATENT DOCUMENTS

| | | | | | |
|---|---|---|---|---|---|
| 3,139,854 | A | * | 7/1964 | Hedges et al. | 116/278 |
| 3,225,170 | A | * | 12/1965 | Chabala et al. | 200/308 |
| 3,644,694 | A | | 2/1972 | Morin et al. | |
| 3,852,556 | A | * | 12/1974 | Kane et al. | 200/310 |
| 3,855,961 | A | * | 12/1974 | Schadow | 116/279 |

(Continued)

FOREIGN PATENT DOCUMENTS

| | | | | | |
|---|---|---|---|---|---|
| DE | 102007047477 | A1 | * | 4/2009 | H01H 71/04 |
| WO | 2011102997 | A1 | | 8/2011 | |

*Primary Examiner* — R. A. Smith
(74) *Attorney, Agent, or Firm* — Michcael C. Prewitt; Robert P. Nupp

(57) ABSTRACT

A recloser includes at least one pole position indicator. The position indicator includes a flexible strip that rides in a U-shaped channel. The flexible strip has an alternating color pattern and that is visible through spaced transparent windows on the indicator. The transparent windows are spaced so that the flexible strip, when in a first position shows only a first color and when in a second position only shows a second color.

9 Claims, 5 Drawing Sheets

(56) References Cited

U.S. PATENT DOCUMENTS

| | | | | | |
|---|---|---|---|---|---|
| 4,051,728 | A | * | 10/1977 | Metz | 374/143 |
| 4,052,954 | A | * | 10/1977 | Roy | 116/285 |
| 4,223,193 | A | | 9/1980 | Iwasaki et al. | |
| 5,663,712 | A | | 9/1997 | Kamp | |
| 5,912,604 | A | * | 6/1999 | Harvey et al. | 335/9 |
| 6,198,062 | B1 | | 3/2001 | Mather et al. | |
| 7,579,571 | B2 | * | 8/2009 | Siebens et al. | 218/120 |
| 2006/0219154 | A1 | * | 10/2006 | Moninski | 116/281 |

* cited by examiner

RECLOSER POSITION INDICATOR

FIELD OF INVENTION

The present application is directed to automatic circuit reclosers, and more particularly, to a recloser that includes at least one pole position indicator.

BACKGROUND

Reclosers are often used in coordinated protection schemes for overhead line distribution circuits. These circuits are prone to transitory faults such as nearby lightning strikes. With a conventional circuit breaker or fuse, a transient fault would open the breaker or blow the fuse, disabling the line until a technician could manually close the circuit breaker or replace the blown fuse. A recloser, however, will make several pre-programmed attempts to re-energize the line. If the transient fault has cleared, the recloser's circuit breaker remains closed and normal operation of the power line resumes. If the fault is a permanent fault (i.e. downed wires), the recloser exhausts its pre-programmed attempts to re-energize the line and remains open (locked-out) until manually directed to close.

Many reclosers include sensors and communication devices that electronically report the open or closed status of a recloser. In addition to electronic devices, many reclosers also include a visual indicator that alerts a nearby utility worker whether the recloser is open or closed. Current indicators have many drawbacks, such as, for example, inadequate visibility one or more viewing angles, including directly below the recloser if it is pole mounted.

SUMMARY

According to one aspect of the present invention, an indicator is provided for a recloser having a moving contact and a stationary contact. The indicator includes an outer housing having a generally U-shaped body and including a side wall having alternating opaque and clear portions. An inner guide is positioned within the outer housing. A generally U-shaped channel is formed between the inner guide and the outer housing. A flexible strip is slidably received within the U-shaped channel and includes an alternating pattern on an outer surface thereof. The alternating pattern includes a first color and a second color. The flexible strip is movable between a first position wherein the first color is visible through the clear portions and a second position wherein the second color is visible through the clear portions.

BRIEF DESCRIPTION OF THE DRAWINGS

In the accompanying drawings, structural embodiments are illustrated that, together with the detailed description provided below, describe exemplary embodiments of a recloser position indicator, or components thereof. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 2:
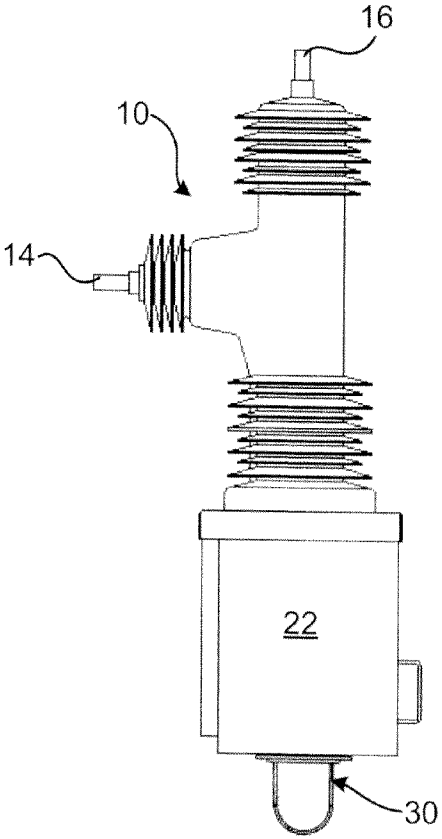
FIG. 2 is a side view of a recloser including the indicator of the present invention.
Figure 1:
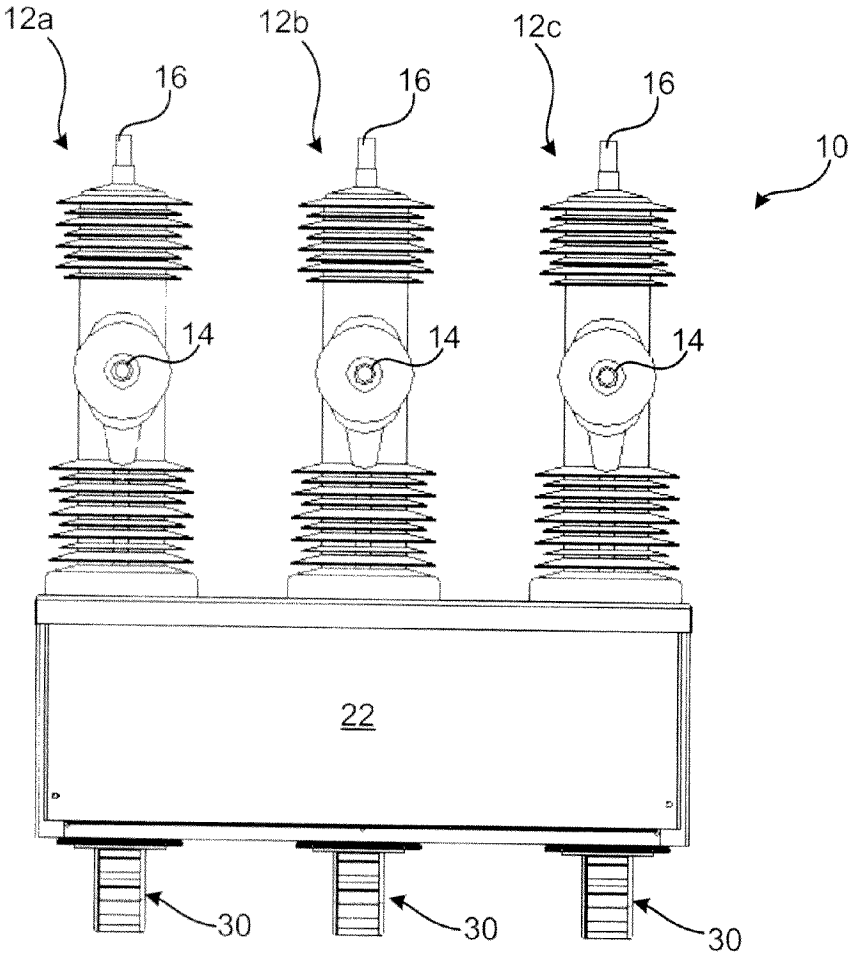
FIG. 1 is a front view of a recloser including the indicator of the present invention.
Figure 3:
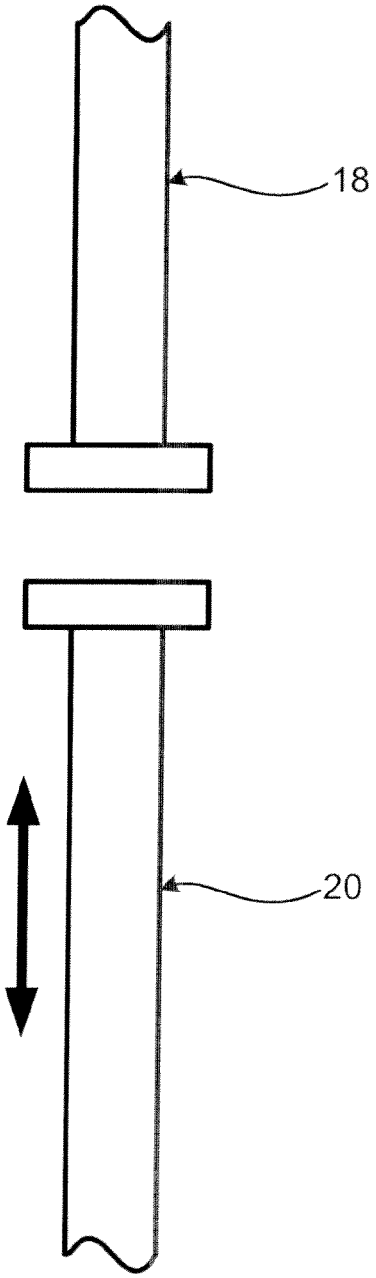
FIG. 3 is a schematic showing the moving and stationary contacts of the recloser.
Figure 4:
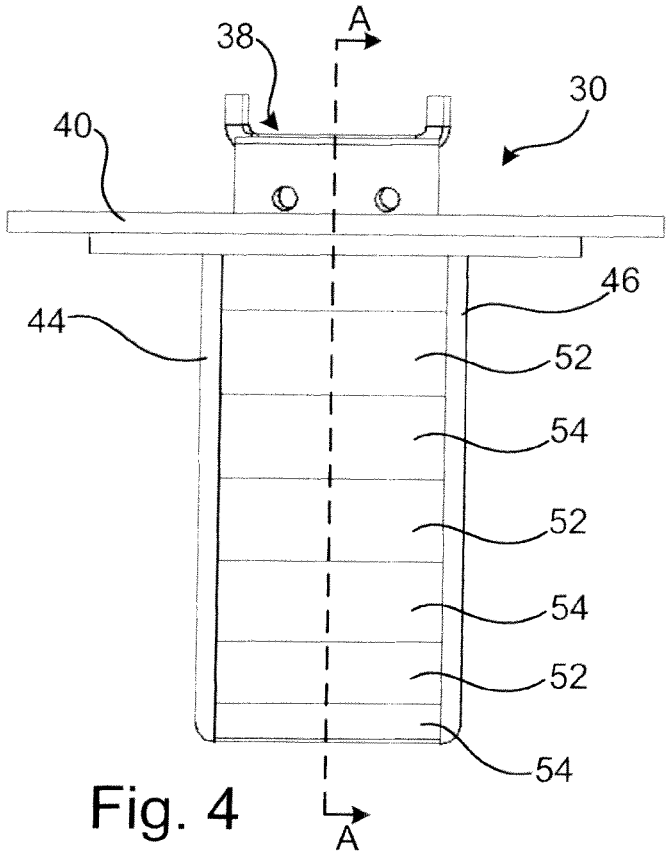
FIG. 4 is a side view of the indicator of the present invention.
Figure 5:
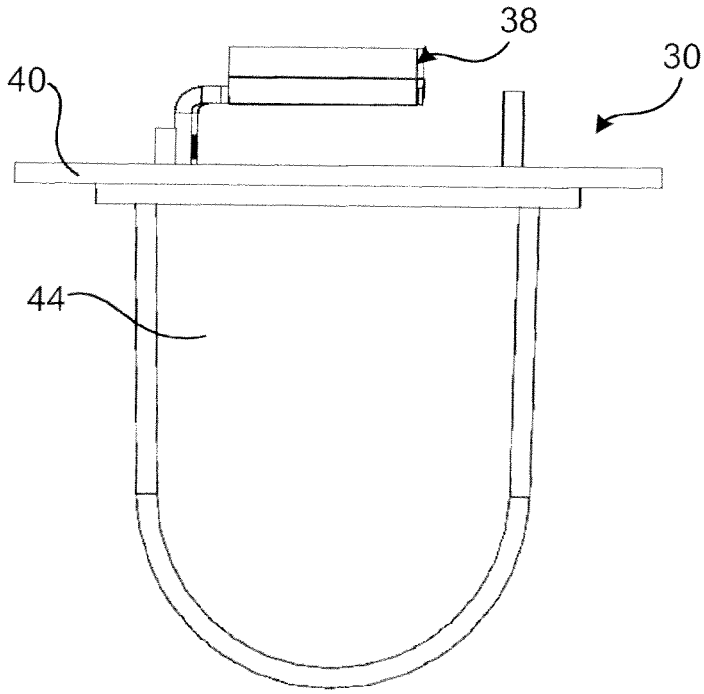
FIG. 5 is a front view of the indicator of the present invention.
Figure 6:
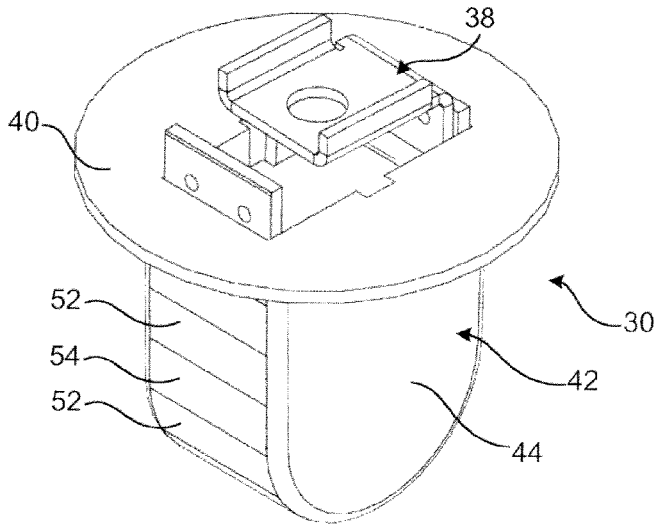
FIG. 6 is an isometric view of the indicator of the present invention.
Figure 7:
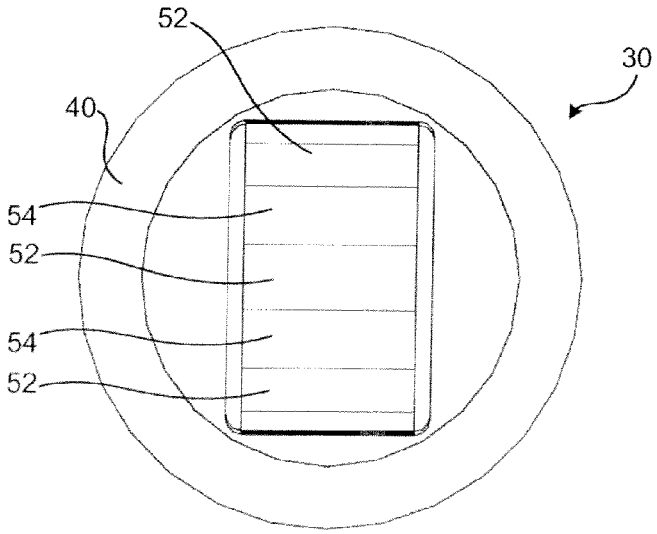
FIG. 7 is a bottom view of the indicator of the present invention.
Figure 8:
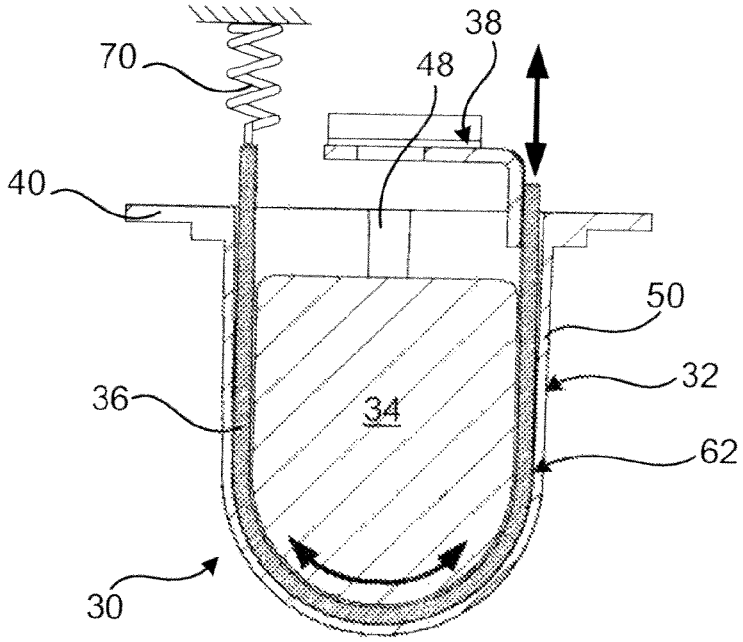
FIG. 8 is a section view along line A-A of FIG. 4.
Figure 9:
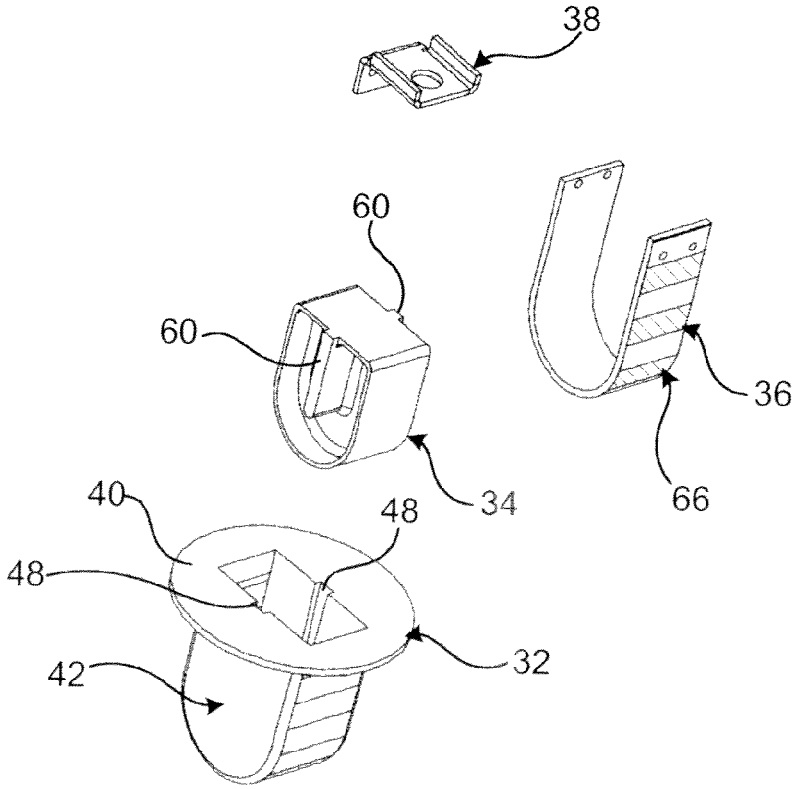
FIG. 9 is an exploded view of the indicator of the present invention.

With reference now to FIGS. 1 and 2, a recloser is shown and indicated by the numeral 10. Recloser 10 may be pole mounted or substation mounted and includes three poles 12*a*, 12*b*, and 12*c*. Each pole 12 includes a first conductor 14 and a second conductor 16. With reference to FIG. 3, which shows a simplified schematic of the pole, each pole includes a stationary contact 18 which is electrically connected to the second conductor and a movable contact 20 that is electrically connected to the first contact 14. An actuator (not shown) selectively moves the movable contact 20 into or out of contact with the stationary contact 18. According to one embodiment, the actuator is a magnetic actuator, however, other actuators may be used. In this manner, the electrical connection between first and second contacts 14 and 16 may be selectively opened and closed.

Recloser 10 includes a base housing 22 that contains the control electronics and actuators. Each actuator may individually open or close a respective pole connection. Accordingly, each pole 12 includes an associated position indicator 30. As can be seen in FIG. 1, each indicator 30 is aligned with an associated pole 12, and is positioned on the opposed side of the base housing 22 from the associated pole 12. Thus, it is easily identifiable which pole 12 an indicator 30 is associated with. According to another embodiment, if the poles 12 are ganged (i.e. all three poles open and close together), only one indicator 30 is necessary to indicate pole position.

With reference now to FIGS. 4-9, the indicator 30 is shown in greater detail. Each indicator 30 includes an outer housing 32, an inner guide 34, a flexible strip 36 and a mounting bracket 38. Outer housing 32 is made of a molded plastic material and includes a flange portion 40 that abuts the surface of base housing 22 to form a seal to prevent contaminates and/or moisture from entering base housing 22. Extending from flange portion 40 is a generally U-shaped body 42.

U-shaped body 42 includes opposed front and rear walls 44 and 46 that each include a longitudinally extending slot 48 that, as will be described later, interact with features on the inner guide 34. A side wall 50 extends between front and rear walls 44 and 46. Side wall 50 includes alternately located relatively opaque portions 52 and relatively clear portions 54 along substantially the entire length thereof.

The inner guide 34 is generally U-shaped and is sized to fit within outer housing 32. Guide 34 includes a pair of opposed projections 60 that are shaped to be slidingly received in slots 48. In this manner guide 34 is positioned and secured relative to outer housing 32. When assembled, a channel 62 is formed between guide 34 and side wall 50. Channel 62 is generally U-shaped and is sized to receive flexible strip 36 therein, as will be described below in greater detail.

Flexible strip 36 may be made of any flexible material. For example, flexible strip 36 may be a two ply including polyester monofilament plies with a PVC cover on the top side, and bare polyester fabric on the bottom side; hard nylon top layer, polyester plies and a bare nylon bottom layer; Elastomer impregnated polyester; leather; nylon; silicone; EPDM; Neoprene; flouroelastomer; SBR rubber; NBR coated nylon fabric; Teflon; or acetal (POM). Flexible strip 36 is sized so that it extends substantially the entire length of channel 62. An alternating pattern 66 is located on the outer surface of flexible strip 36. According to one embodiment, the alternating pattern 66 is formed by a reflective tape including alternating red and green portions. The spacing between the alternating colors or patterns matches the spacing of the alternating opaque and clear portions of the outer housing side wall 50. In this manner, when aligned properly only one color or the other color is visible through the visible portions 54 of the housing. For example, if the alternating pattern includes reflective red and reflective green areas, the flexible strip 36 may be positioned in channel 62 so that only the red portions are visible or only the green portions are visible.

Flexible strip 36 is coupled to mounting bracket 38, which is in turn mechanically, though not electrically, interconnected to the moving contact 20. Thus, when movable contact 20 moves upwardly or downwardly relative to the stationary contact 18, it causes the mounting bracket 38 to move upwardly or downwardly. This in turn causes flexible strip 36 to slide within channel 62 and reveal (if the alternating pattern is red and green reflective areas) either the red or green portions of the alternating pattern. According to one embodiment a spring 70 is coupled to flexible strip 36 at the end opposed from mounting bracket 38. Spring 70 applies a tension to flexible strip 36 that, though it is easily overcome by the force from the moving contact 20 (as exerted through bracket 38), prevents buckling According to one embodiment, the alternating pattern 66 and alternating opaque and clear portions 52 and 54 are sized so that when moving contact 20 is in the closed position (in contact with stationary contact 18) the first of the two colors of the alternating pattern 66 is revealed through the clear portions 52. When moving contact 20 is in the open position (retracted from stationary contact 18) the second of the two colors of the alternating pattern 66 is revealed through the clear portions 52. In this manner, the status (open or closed) of each pole of the recloser is clearly displayed by indicator 30.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

I claim:

1. An indicator for a recloser having a moving contact and a stationary contact, the indicator comprising:

an outer housing having a generally U-shaped body and including a side wall having alternating opaque and clear portions;

an inner guide positioned within said outer housing;

a generally U-shaped channel formed between said inner guide and said outer housing;

a flexible strip slidably received within said U-shaped channel and including an alternating pattern on an outer surface thereof; and wherein said alternating pattern comprises a first color and a second color, said flexible strip being movable between a first position wherein said first color is visible through said clear portions and a second position wherein said second color is visible through said clear portions.

2. The indicator according to claim 1 further comprising a mounting bracket coupled to a first end of said flexible strip, said mounting bracket being mechanically interconnected with the moving contact of the recloser.

3. The indicator according to claim 1 wherein said first color is red and said second color is green.

4. The indicator according to claim 1 wherein flexible strip is in said first position when the moving contact is engaged with the stationary contact.

5. The indicator according to claim 4 wherein the flexible strip is in said second position when the moving contact is disengaged from the stationary contact.

6. The indicator according to claim 1 wherein said outer housing further comprises a ring shaped flange.

7. The indicator according to claim 1 wherein said alternating pattern formed by a reflective tape.

8. The indicator according to claim 1 wherein said flexible strip extends substantially the entire length of the U-shaped channel.

9. The indicator according to claim 1 wherein said outer housing includes a plurality of longitudinally extending slots and said inner guide includes a plurality of projections, said projections being received in said longitudinally extending slots.

* * * * *